United States Patent [19]

Rave

[11] 4,079,043

[45] Mar. 14, 1978

[54] GLYOXAL MODIFIED POLY(BETA-ALANINE) STRENGTHENING RESINS FOR USE IN PAPER

[75] Inventor: Terence W. Rave, Wilmington, Del.

[73] Assignee: Hercules Incorporated, Wilmington, Del.

[21] Appl. No.: 657,673

[22] Filed: Feb. 12, 1976

Related U.S. Application Data

[63] Continuation-in-part of Ser. No. 521,002, Nov. 4, 1974, abandoned.

[51] Int. Cl.[2] ..... C08F 8/28; C08G 69/50; C08G 12/22; D21D 3/00

[52] U.S. Cl. ..... 260/72 R; 162/166; 162/168 NA; 526/23; 526/55

[58] Field of Search ..... 260/72 N, 72 R

[56] References Cited

U.S. PATENT DOCUMENTS

| | | | |
|---|---|---|---|
| 2,749,331 | 6/1956 | Breslow | 260/72 N |
| 3,320,215 | 5/1967 | Conte et al. | 260/72 N |
| 3,734,977 | 5/1973 | Coscia et al. | 260/72 R |
| 3,853,816 | 12/1974 | Williams et al. | 260/72 R |

*Primary Examiner*—John C. Bleutge
*Attorney, Agent, or Firm*—Marion C. Staves

[57] ABSTRACT

Novel resins, useful as strengthening resins for imparting dry and temporary wet strength to paper, are disclosed. The resins are prepared by reacting branched water-soluble poly(beta-alanine) with glyoxal.

5 Claims, No Drawings

GLYOXAL MODIFIED POLY(BETA-ALANINE) STRENGTHENING RESINS FOR USE IN PAPER

This application is a continuation-in-part of applicant's copending application Ser. No. 521,002, filed Nov. 4, 1974 now abandoned.

This invention relates to novel resins which impart dry strength and temporary wet strength to paper.

It is known to add certain resins to paper, usually during the paper-making process, to improve wet and/or dry strength of paper. The type of resin added depends on the properties desired in the final paper product. For tissue, towelling and certain other applications, it is desirable that the strengthening resin added to the paper impart dry and temporary wet strength.

Numerous resins are known in the art that will achieve these results. For example, U.S. Pat. Nos. 3,607,622, 3,728,214 and 3,778,215 to Espy relate to resins which impart both dry strength and temporary wet strength to paper. The resins of Espy are prepared by reacting certain polyamines and aminopolyamides with an acrylamide and then with a polyaldehyde. Also, U.S. Pat. No. 3,556,932 to Coscia et al teaches wet and dry strength resins which are ionic water-soluble vinylamide polymers having glyoxal-reactive amide substituents and sufficient —CHOHCHO substituents to be thermosetting. The polymers are produced by reacting glyoxal with vinylamide polymers, such as ionic copolymers of acrylamide with monomers which will impart ionic properties to the polymer, e.g., diallyldimethyl ammonium chloride and 2-methyl-5-vinylpyridine. The vinylamide polymers are produced under conditions which result in addition polymerization of acrylamide through the double bond of the vinyl group. After modification with glyoxal, there is produced a polymer composed of units having the formula

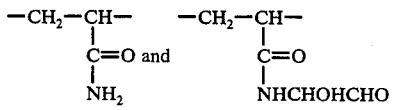

While these resins do impart dry and temporary wet strength to paper, they have the disadvantage of a relatively short shelf life when stored in aqueous solution at concentrations at which they are generally used during the paper-making process.

In accordance with this invention, it has been found that glyoxal modified poly(beta-alanine) resins are effective dry strength and temporary wet strength resins for papers. The novel resins of this invention are stable in aqueous solution at relatively high solids concentration and have a long shelf life. Accordingly, the present invention relates to novel resins prepared by (a) polymerizing acrylamide in the presence of a basic catalyst and a free-radical inhibitor to produce branched water-soluble poly(beta-alanine);

(b) dissolving the poly(beta-alanine) in water to provide an aqueous solution having a solids content of about 11 to about 40%; and (c) adding glyoxal in the amount of about 10 to about 100 mole %, based on the amide repeating units of the poly(beta-alanine), thus producing a glyoxal-modified poly(beta-alanine).

The poly(beta-alanine) used in preparing the novel resins of this invention is a branched, water-soluble, poly(beta-alanine) prepared by the anionic polymerization of acrylamide in the presence of a basic catalyst and a vinyl polymerization inhibitor. Anionic polymerization of acrylamide results in a polymer backbone of beta-alanine repeating units. The preparation of linear crystalline poly(beta-alanine) by the anionic polymerization of acrylamide is described in U.S. Pat. No. 2,749,331 to Breslow. Water-soluble and water-insoluble forms of the polymer are obtained. In later work it was determined that the water-soluble form of poly(beta-alanine) can be either a linear crystalline polymer of relatively low molecular weight or a higher molecular weight polymer having a branched structure. Branched, poly(beta-alanine) contains repeating units of the formula $^{\sim}CH_2CH_2CONH^{\sim}$ in the linear segments and repeating units of the formula $^{\sim}CH_2CH_2CON^{\sim}$ in the segments at which branching occurs. Primary amide end groups will occur at the end of each branch chain. Hydrolysis of water-soluble branched poly(beta-alanine) produces beta-alanine, $NH_2CH_2CH_2COOH$, from the linear segments, iminodipropionic acid, $HN(CH_2CH_2COOH)_2$, from the points of branching and ammonia from the primary amide end groups.

This provides a basis for measuring the degree of branching present in a given sample of poly(beta-alanine). On hydrolysis of the sample the ammonia and/or iminodipropionic acid produced can be measured, thus providing a determination of the degree of branching. The amount of ammonia liberated indicates the number of primary amide groups and since such groups are present only as end groups of the branch chains, an indication of the amount of branching of the poly(beta-alanine) can be determined. Any poly(beta-alanine) containing sufficient branching to be water-soluble is suitable for use in this invention. In general, the branched poly(beta-alanine) should contain about one primary amide group for every two to six amide groups present. The molecular weight of branched water-soluble poly(beta-alanine) suitable for use in this invention is in the range of about five hundred to about ten thousand and preferably in the range of about two thousand to about six thousand.

As stated above, the branched water-soluble poly(beta-alanine) is prepared by the anionic polymerization of acrylamide in the presence of a basic catalyst and a vinyl or free-radical polymerization inhibitor. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane.

The concentration of the acrylamide monomer in the reaction medium is in the range of about 2% to about 30%, and is preferably about 8% to about 15%.

If desired, an organo-soluble polymeric dispersing agent can be added to the reaction mixture prior to the addition of the basic catalyst. When the dispersing agent is employed, the poly(beta-alanine) produced is in powdered or bead form, easily filterable from the reaction medium. Suitable dispersing agents are styrene-butadiene copolymers, polyisoprene, chlorinated polypropylene, chlorinated and maleated polyisoprene, and chlorinated and maleated polyolefins.

Illustrative basic catalysts which can be employed include alkali metals, alkali metal hydroxides, alkaline earth metal hydroxides, quaternary ammonium hydroxides and the corresponding alkoxides. Examples of suitable basic catalysts are sodium metal, sodium hydroxide, lithium hydroxide, potassium hydroxide, sodium t-butoxide, sodium methoxide, tetramethylammonium hydroxide, potassium t-butoxide, and calcium hydroxide. The amount of catalyst used is in the range of about 0.01 to about 2.0 mole % preferably about 0.1 to about 1.5 mole % based on the monomer.

A free radical inhibitor is added to the reaction mixture to inhibit vinyl polymerization through the double bond of the acrylamide monomer. Examples of free radical inhibitors which can be used are phenyl-beta-naphthylamine hydroquinone, diphenylamine, and phenothiazine.

The anionic polymerization reaction is conducted at temperatures in the range of about 40° to about 140° C. and preferably about 80° to about 130° C.

In many cases, the anionic polymerization of acrylamide under the above conditions will produce a mixture of water-soluble and water-insoluble poly(beta-alanine). The water-soluble polymer for use in this invention can be readily separated by partially dissolving the polymer product in water and removing the insoluble fraction by conventional methods such as filtration, etc.

The final step in preparing the novel resins of this invention is the reaction of poly(beta-alanine) with glyoxal. This reaction is carried out in aqueous solution. The solids concentration of poly(beta-alanine) in the aqueous solution should be above about 10% and can be from about 11% to about 40% with about 12.5% to about 25% being the preferred range. The amount of glyoxal used in this reaction can be from about 10 to about 100 mole % and is preferably about 20 to about 30 mole %, based on the amide repeating units of the poly(-beta-alanine). The temperature of the reaction is from about 10° to about 50° C., preferably about 20° to about 30° C.

The reaction between the glyoxal and poly(beta-alanine) is continued until a viscosity increase of about 2 to about 10, preferably 4–6 viscosity units on the Gardner-Holdt scale has taken place. The viscosity increase indicates that a certain amount of crosslinking of the poly(-beta-alanine) has taken place. The amount of crosslinking is insufficient to cause gelation of the poly(beta-alanine) solution but is adequate to provide polymeric units of sufficiently high molecular weight to be retained by the cellulose fibers when used as a paper strengthening resin.

The glyoxal modified poly(beta-alanine) resins of this invention can be used to impart dry strength and temporary wet strength to paper using any conventional method. Aqueous solutions of the resins may be applied to the formed paper sheet, e.g., by spraying, or tub application, etc. The amount of glyoxal modified poly(-beta-alanine) added to the paper to impart dry and temporary wet strength is 0.05 to 2% and usually 0.1 to 1% by weight based on weight on the cellulose fibers.

The following example will serve to illustrate the invention, parts and percentages being by weight unless otherwise indicated.

EXAMPLE

This example illustrates the preparation of a typical glyoxal-modified poly(beta-alanine) of this invention and its use as a dry and temporary wet strength resin for paper.

Part A In a round-bottomed 3-necked flask equipped with a paddle stirrer, thermometer, and condenser are placed 200 parts dry acrylamide, 0.44 part phenyl-beta-naphthylamine, and 400 parts dry toluene. The mixture is heated 30 minutes under an atmosphere of nitrogen at 100° C. with stirring to melt and partially dissolve the acrylamide. Then 4 parts of 1.2 N potassium t-butoxide in t-butanol is added and the mixture heated at about 90° C. for 18 hours. The hot toluene is decanted and the resulting solid polymer is washed with acetone. The polymer is water-soluble, branched poly(beta-alanine).

Part B A 30% aqueous solution of the neutral poly(beta-alanine) prepared as described above is warmed to 40° to 50° C. To this solution is added 50 mole % (based on amide units in the polymer) of glyoxal as a 40% aqueous solution. The pH of the resulting solution is raised to about 9.5 and maintained at room temperature for about 10 minutes during which time there is an increase in Gardner viscosity. Then the solution quickly is diluted with water to 4% total solids and adjusted to pH 5.5 with sulfuric acid.

Part C The glyoxal modified neutral poly(beta-alanine) prepared in Part B is evaluated as dry and wet strength resins in hand-sheets prepared from 100% Rayonier bleached kraft pulp (40 lbs./ream). The handsheets are soaked for 1 minute in a 20% aqueous solution of the glyoxal modified neutral poly(beta-alanine) at a pH of 6.0. The handsheets are then passed through a nip roll and drum dried at 100° C.

Strength data for the thus treated sheets are compared with untreated handsheets as tabulated below.

| | Tensile Strength (lbs./in.)* | | |
|---|---|---|---|
| | Dry | Wet (10 seconds) | Wet (2 hours) |
| Untreated handsheets | 19.6 | 0.9 | — |
| Treated handsheets | 24.3 | 8.1 | 2.6 |

*Tensile strengths are corrected to 40 lbs./ream basic weight.

What I claim and desire to be protected by Letters Patent is:

1. A water-soluble resin which comprises the reaction product of a branched water-soluble poly(beta-alanine) having a molecular weight in the range of about 500 to about 10,000 with from about 10 to about 100 mole %, based on the amide repeating units of the poly(beta-alanine) of glyoxal, said poly(beta-alanine) having been prepared by the anionic polymerization of acrylamide in a suitable organic reaction medium inert to the reaction conditions in the presence of a basic catalyst and a free-radical inhibitor.

2. The resin of claim 1 wherein the basic catalyst is sodium hydroxide.

3. The resin of claim 1 wherein the basic catalyst is sodium t-butoxide.

4. The resin of claim 1 wherein the free-radical inhibitor is phenyl-beta-naphthylamine.

5. The process of preparing a glyoxal-modified poly(-beta-alanine) which comprises:

(a) anionically polymerizing acrylamide in the presence of a basic catalyst and a free-radical inhibitor in a suitable organic reaction medium inert to the reaction conditions to produce branched water-soluble poly(beta-alanine) having a molecular weight in the range of about 500 to about 10,000;

(b) dissolving the poly(beta-alanine) in water to provide an aqueous solution having a solids content of about 11 to about 40%; and (c) adding glyoxal in the amount of about 10 to about 100 mole %, based on the amide repeating units of the poly(beta-alanine) and continuing the reaction at a temperature from about 10° C. to about 50° C. until a viscosity increase of about 2 to about 10 units on the Gardner-Holdt scale has taken place, thus producing a glyoxal-modified poly(beta-alanine).

* * * * *